United States Patent [19]

Toudo et al.

[11] 4,311,576

[45] Jan. 19, 1982

[54] ELECTRIC CORROSION PREVENTING APPARATUS

[75] Inventors: Kenzi Toudo; Motoshi Miyanaka; Ikuo Saeki; Yosiaki Nakaoka, all of Yanai, Japan

[73] Assignee: Hitachi, Ltd., Tokyo, Japan

[21] Appl. No.: 187,630

[22] Filed: Sep. 16, 1980

[51] Int. Cl.[3] ..... C23F 13/00

[52] U.S. Cl. ..... 204/196; 315/135; 324/51; 324/133; 340/654

[58] Field of Search ..... 204/147, 196; 340/654; 315/135; 324/133, 51

[56] References Cited

U.S. PATENT DOCUMENTS

| | | | |
|---|---|---|---|
| 2,759,177 | 8/1956 | Hightower | 340/654 |
| 3,696,365 | 10/1972 | Ward | 340/654 |
| 3,953,742 | 4/1976 | Anderson et al. | 204/196 X |
| 4,139,820 | 2/1979 | Rode | 324/133 |

*Primary Examiner*—G. L. Kaplan
*Attorney, Agent, or Firm*—Craig and Antonelli

[57] ABSTRACT

An electric corrosion preventing apparatus with a circuit having an indication lamp for indicating an operation state of the apparatus, which is used for preventing an inside wall of a hot-water receptacle, such as a water heater and a boiler, from being corroded by rust. In the circuit, the secondary winding of a voltage-dropping transformer is provided with a couple of diode-capacitor combinations. Those diode-capacitor combinations, respectively, are used for rectifying positive and negative parts of a low AC voltage produced by the secondary winding into positive and negative DC voltages. A positive DC voltage is coupled with an electric corrosion prevention load while a negative DC voltage is coupled with a lamp load. With this circuit arrangement, the positive part of the AC voltage is used for the electric corrosion prevention while the negative part, for the lamp.

2 Claims, 7 Drawing Figures

ELECTRIC CORROSION PREVENTING APPARATUS

BACKGROUND OF THE INVENTION

The present invention relates to an electric corrosion preventing apparatus with a circuit having an indication lamp. This apparatus is used for preventing an inside wall of a hot-water receptacle, such as a water heater and a boiler, from being corroded by rust.

A conventional electric corrosion apparatus is shown in FIG. 1. As shown, a half-wave rectifying circuit having a diode 3 and a capacitor 4 is coupled with a secondary winding of a transformer 2 for dropping voltage of a commercial AC power source. A positive part of the output voltage is electrically connected to a corrosion prevention electrode 7 in water, supported by an insulating member mounted on a wall of a receptacle 5. A negative side of the output voltage is electrically connected to the receptacle 5. Reference numeral 8 represents a lamp and 9 is a resistor.

When the AC power source is turned on, a low AC voltage is developed in the secondary winding of the voltage-dropping transformer 2. A positive part a of the AC voltage developed as shown in FIG. 2 is rectified by half-wave and then smoothed to a DC current I as shown in FIG. 3. The current I is divided into a current $I_1$ flowing through the resistor 9 into the lamp 8 and a current $I_2$ flowing through a route of an electrode 7, the water 6 and the receptacle 5. The current $I_1$ lights the lamp 8 to indicate that the power source is now turned on. The current $I_2$ prevents the inner surface of the receptacle 5 from being corroded.

Resistance of the water 6 within the receptacle or a tank changes depending on the temperature and water quality. In the above construction, the current $I_2$ accordingly changes depending on the above change. In accordance with the change of the current $I_2$, the current $I_1$ changes. When the current $I_1$ is changed to low, the light intensity of the lamp is insufficient. On the other hand, when the current $I_1$ is high, the life of the lamp 6 is undesirably shortened.

Because of the half-wave rectifying circuit for the power source circuit, the efficiency of the voltage-dropping transformer is undesirably poor, the transformer is bulky, and the capacitance of the capacitor 4 is large.

SUMMARY OF THE INVENTION

An object of the present invention is to provide an electric corrosion preventing apparatus with a circuit having an indication lamp, the current flowing into the indication lamp being not influenced by a change of corrosion preventing current.

Another object of the present invention is to provide an electric corrosion preventing apparatus which is small in size and low in cost.

In brief, positive and negative parts of an AC output from the secondary coil of the voltage dropping transformer, respectively, are used for two individual purposes, not influencing each other.

Other objects and features of the present invention will be apparent from the following description taken in connection with the accompanying drawings, in which:

DETAILED DESCRIPTION OF THE PREFERRED EMBODIMENT

The present invention will be described by using an embodiment shon in FIGS. 4 through 7.

Figure 1:
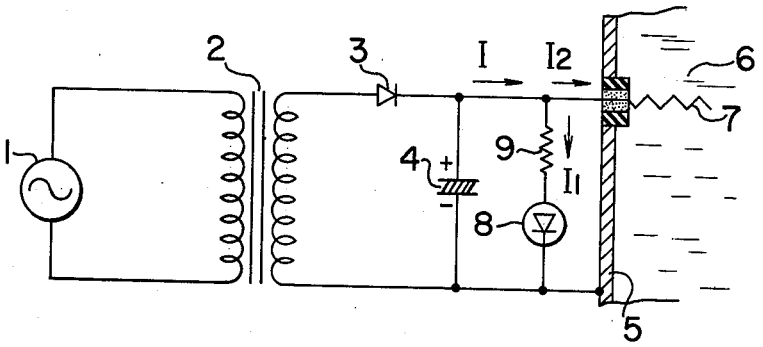
FIG. 1 is a circuit diagram of a conventional electric corrosion preventing apparatus.
Figure 2:
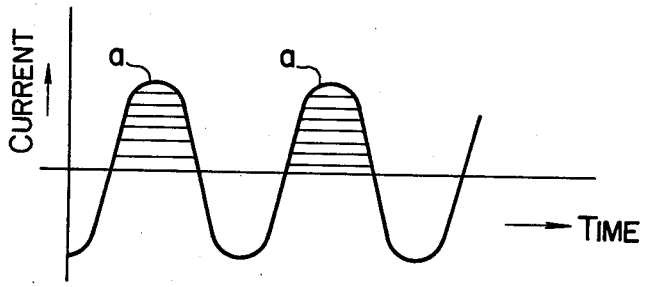
FIG. 2 is a waveform diagram of a low AC voltage used in the apparatus shon in FIG. 1.
Figure 3:
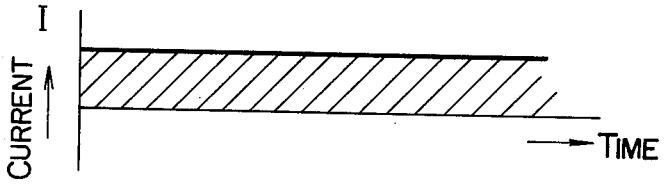
FIG. 3 is a waveform of a current flowing through an electric corrosion preventing section and an indication lamp.
Figure 4:
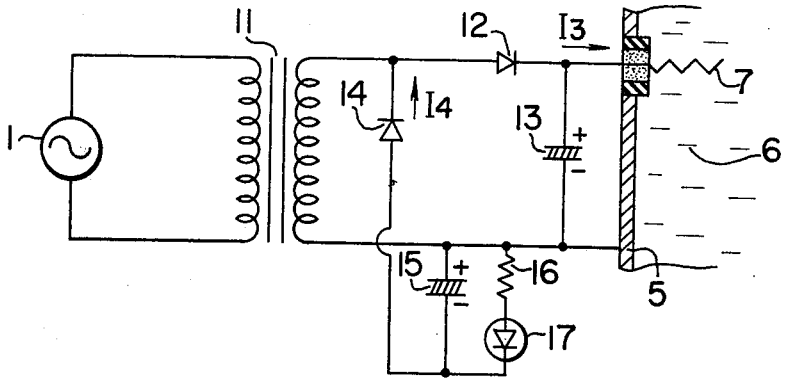
FIG. 4 is a circuit diagram of an electric corrosion preventing apparatus according to an embodiment of the present invention.
Figure 5:
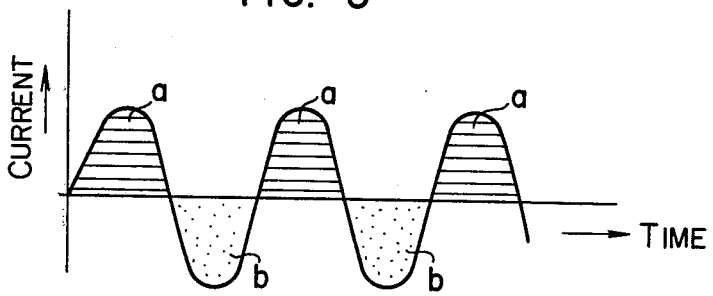
FIG. 5 is a waveform diagram of a low AC voltage in the embodiment of the invention.
Figure 6:
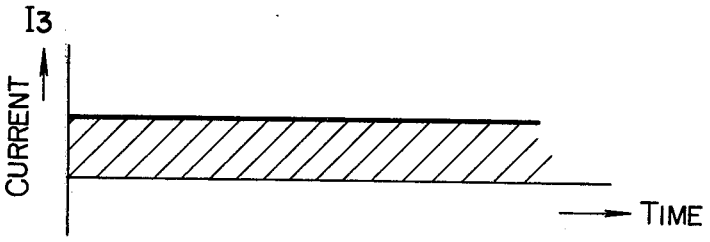
FIG. 6 is a waveform diagram of a current for electric corrosion prevention in the embodiment.
Figure 7:
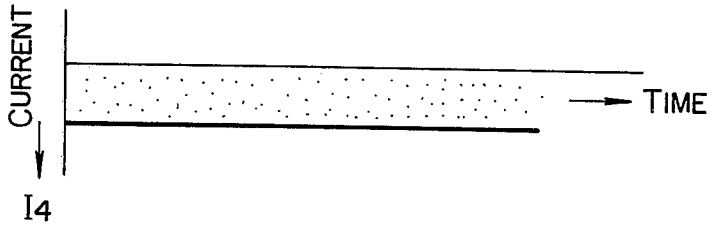
FIG. 7 is a waveform diagram of a current driving a lamp in the embodiment.

A low AC voltage is produced from a secondary winding of a voltage dropping transformer 11 supplied with a commercial AC power source 1. A positive part a of the AC current developed shown in FIG. 5 is half-wave rectified by half-wave and smoothed by the combination of a diode 12 and a capacitor 13, into a DC current $I_3$ shown in FIG. 6. The DC current $I_3$ is coupled with a corrosion preventing electrode 7 to prevent the receptacle from being corroded. On the other hand, a negative part b of the AC current shown in FIG. 5 is similarly half-wave rectified and smoothed, by the combination of a diode 14 and a capacitor 15, into a DC current $I_4$ shown in FIG. 7. The current $I_4$ is applied through a resistor 16 to a lamp 17 to light the same.

Thus the current $I_4$ flowing through the lamp 17 uses the negative part b of the AC current shown in FIG. 5, which is opposite in phase to the positive part a used for the corrosion prevention. For this reason, the current $I_4$ is fixed, with the result that the light intensity of the lamp 17 is constant and the lamp has a long life with a stable operation.

By using the apparatus with a relation of $I_2 \approx I_4$, the efficiency of the voltage dropping transformer is remarkably improved and the transformer is made compact.

We claim:

1. An electric corrosion preventing apparatus-circuit combination comprising; a receptacle for receiving liquid, an electrode adapted to contact said liquid as an anode, a lamp for indicating an operation state of said apparatus, a single transformer for transforming a commercial AC voltage to a low AC voltage, a first diode-capacitor combination for producing a first DC current from a positive part of said low AC voltage obtained by a secondary coil of said transformer, and a second diode-capacitor combination for producing a second DC current from a negative part of said low AC voltage, means connecting said receptacle as a cathode to said circuit, wherein said first and second DC currents are applied to said electrode and said lamp respectively.

2. An electric corrosion preventing apparatus as claimed in claim 1, wherein the value of said first DC current is substantially equal to that of said second DC current.

* * * * *